US010920728B2

(12) United States Patent
Zhang et al.

(10) Patent No.: US 10,920,728 B2
(45) Date of Patent: Feb. 16, 2021

(54) FUEL INJECTOR, METHOD FOR ASCERTAINING THE POSITION OF A MOVABLE ARMATURE, AND MOTOR CONTROL

(71) Applicant: CONTINENTAL AUTOMOTIVE GMBH, Hannover (DE)

(72) Inventors: Hong Zhang, Tegernheim (DE); Nikolay Belyaev, Regensburg (DE); Anatoliy Lyubar, Wolfsegg (DE); Gerd Rösel, Regensburg (DE); Markus Stutika, Regensburg (DE)

(73) Assignee: Vitesco Technologies GMBH, Hannover (DE)

( * ) Notice: Subject to any disclaimer, the term of this patent is extended or adjusted under 35 U.S.C. 154(b) by 192 days.

(21) Appl. No.: 15/917,110

(22) Filed: Mar. 9, 2018

(65) Prior Publication Data

US 2018/0195482 A1 Jul. 12, 2018

Related U.S. Application Data

(63) Continuation of application No. PCT/EP2016/066042, filed on Jul. 6, 2016.

(30) Foreign Application Priority Data

Sep. 11, 2015 (DE) ..... 10 2015 217 362.3

(51) Int. Cl.
*F02M 63/00* (2006.01)
*F02M 51/06* (2006.01)
(Continued)

(52) U.S. Cl.
CPC .... *F02M 63/0024* (2013.01); *F02M 51/0685* (2013.01); *F02M 51/0689* (2013.01);
(Continued)

(58) Field of Classification Search
CPC ..... F02M 63/0024; F02M 51/0689; F02M 51/0692; F02M 51/0685; F02M 2200/20;
(Continued)

(56) References Cited

U.S. PATENT DOCUMENTS 5,127,585 A 7/1992 Mesenich
5,245,501 A 9/1993 Locher et al.
(Continued)

FOREIGN PATENT DOCUMENTS

CN 101016874 A 8/2007
CN 102770925 A 11/2012
(Continued)

OTHER PUBLICATIONS

Korean Office Action dated Oct. 11, 2019 for corresponding German Patent Application No. 10-2018-7007007.
(Continued)

*Primary Examiner* — Hung Q Nguyen

(57) ABSTRACT

A fuel injector for an internal combustion engine of a motor vehicle. The fuel injector including the following: (a) a pole piece, (b) an armature which can be moved along a movement axis, (c) a coil and (d) a permanent magnet, wherein the movable armature has at least one electrically insulating element which is designed to reduce eddy currents in the armature, and wherein the permanent magnet is fitted such that it generates a magnetic field which produces a force which acts on the armature in the direction of the pole piece. The invention also describes a method for ascertaining a position of a movable armature in a fuel injector and also an engine controller.

19 Claims, 5 Drawing Sheets

(51) Int. Cl.
*H01F 7/16* (2006.01)
*F02D 41/20* (2006.01)

(52) U.S. Cl.
CPC ..... *F02M 51/0692* (2013.01); *H01F 7/1615* (2013.01); *F02D 2041/2051* (2013.01); *F02D 2041/2055* (2013.01); *F02M 2200/08* (2013.01); *F02M 2200/20* (2013.01); *H01F 2007/1676* (2013.01)

(58) Field of Classification Search
CPC ..... F02M 2200/08; H01F 7/1615; H01F 2007/1676; F02D 2041/2051; F02D 2041/2055
See application file for complete search history.

(56) References Cited

U.S. PATENT DOCUMENTS

2012/0305816 A1 12/2012 Pohlmann et al.
2014/0110508 A1* 4/2014 Dames ..... F02M 51/0689 239/585.1

FOREIGN PATENT DOCUMENTS

DE 2756053 A1 6/1978
DE 3843138 A1 6/1990
DE 102008001822 A1 11/2009
DE 102009045307 A1 4/2011
DE 102009047525 A1 6/2011
EP 2392815 A1 12/2011
EP 2455603 A1 5/2012
JP 2003035240 A 2/2003
JP 2013011245 A 1/2013
JP 2013065178 A 4/2013
JP 2013513226 A 4/2013
JP 2014235916 A 12/2014
WO 2008028509 A1 3/2008
WO 2009138297 A1 11/2009

OTHER PUBLICATIONS

China Office Action dated Jul. 2, 2019 for corresponding China patent application 201680052483.

Korean Notice of Allowance dated Feb. 13, 2020 for the counterpart Korean Patent Application No. 10 2018 7007007.

International Search Report and Written Opinion dated Sep. 27, 2016 from corresponding International Patent Application No. PCT/EP2016/066042.

German Office Action dated May 31, 2016 for corresponding German Patent Application No. 10 2015 217 362.3.

* cited by examiner

FUEL INJECTOR, METHOD FOR ASCERTAINING THE POSITION OF A MOVABLE ARMATURE, AND MOTOR CONTROL

CROSS-REFERENCE TO RELATED APPLICATIONS

This application claims the benefit of PCT Application PCT/EP2016/066042, filed Jul. 6, 2016, which claims priority to German Patent Application 10 2015 217 362.3, filed Sep. 11, 2015. The disclosures of the above applications are incorporated herein by reference.

FIELD OF THE INVENTION

The present invention relates to the technical field of fuel injectors. The present invention relates, in particular, to a fuel injector for an internal combustion engine of a motor vehicle. The present invention also relates to a method for ascertaining a position of a movable armature in a fuel injector for an internal combustion engine of a motor vehicle, and also to an engine controller which is designed to use the method.

BACKGROUND OF THE INVENTION

FIG. 1 shows a solenoid injector 1 with an idle stroke between the armature 3 and the nozzle needle 5. When a voltage is applied to the coil 4 which is fitted in the coil housing 7, the armature 3 is moved in the direction of the pole piece 2 by electromagnetic forces. Owing to mechanical coupling, the nozzle needle 5 then likewise moves after overcoming the idle stroke and exposes injection holes for supplying fuel. The armature 3 and the nozzle needle 5 continue to move until the armature 3 strikes the pole piece 2 (needle stroke). In order to close the injector 1, the excitation voltage is disconnected and therefore the magnetic force falls. The nozzle needle 5 and the armature 3 are moved to the closed position by the spring force of the spring 6. The idle stroke and the needle stroke are passed through in reverse order. In fuel injectors without an idle stroke, an idle stroke does not first have to be overcome; in other respects, a fuel injector of this kind is actuated in a similar manner.

Both mechanical tolerances during manufacture and electrical tolerances during actuation lead to differences in the opening and closing process between various injectors. The resulting injector-specific variations in time with respect to the beginning of the needle movement (opening) and the end of the needle movement (closing) produce different injection quantities.

It is possible to remove the variation in quantities caused by the abovementioned tolerances in a known manner. The measurement of the characteristic signals which are superimposed on the coil current or the voltage, as described in patent application DE 38 43 138 A1, is preferably used. It is known there that a feedback signal can be obtained from coil-operated assemblies by the eddy current-driven coupling between the mechanical system (armature 3 and injector needle 5) and the magnetic circuit (coil 4 and the magnetic parts around the coil 4, that is to say the armature 3, the pole piece 2, the coil housing 7, the injector housing and the solenoid ring on the top side of the coil which form the magnetic circuit) being used for the purpose of signal generation. The physical effect is based on the speed-dependent self-induction in the electromagnetic circuit as a result of the movement of the armature 3 and of the injector needle 5. A voltage is induced or a characteristic change in the profile of the induced voltage, which voltage is superimposed on the actuation signal (characteristic signal), is produced in the solenoid depending on the movement speed.

The evaluation of the characteristic signal shape is problematic primarily for detecting opening. Since the magnetic circuit is typically magnetically saturated or driven to magnetic saturation during opening and is also influenced by the other static phenomena (for example stray fluxes, nonlinearity) and dynamic phenomena (for example magnetic flux displacement, eddy currents), the reaction on the magnetic circuit is minimal and therefore can be detected only with difficulty. Depending on the design of the magnetic circuit, the characteristic signal may also be very weakly pronounced when detecting the closing time.

Measurements have shown that a large portion (for example approximately 40%) of the electrical energy introduced is consumed by eddy currents and consequently is not available for generating magnetic force or mechanical energy. The precise eddy current loss depends, amongst other things, on the material, the architecture of the fuel injector and the actuation method, but in most cases is considerable For this reason, various possibilities have been considered in order to reduce the eddy currents and therefore to make the coil drive more efficient. However, a reduction in the eddy currents is also accompanied by an adverse effect on the detection options for opening/closing (attenuation of the signal).

SUMMARY OF THE INVENTION

The present invention is based on the object of providing an improved fuel injector with reduced eddy current-related losses which, at the same time, exhibits good detection properties. The present invention is further based on the object of providing a method for ascertaining the armature position in a fuel injector of said kind.

These objects are achieved by the subjects of the independent patent claims. Advantageous embodiments of the present invention are described in the dependent claims.

A first aspect of the invention describes a fuel injector for an internal combustion engine of a motor vehicle. The described fuel injector comprises the following: (a) a pole piece, (b) an armature which can be moved along a movement axis, (c) a coil and (d) a permanent magnet, wherein the movable armature has at least one electrically insulating element which is designed to reduce eddy currents in the armature, and wherein the permanent magnet is fitted such that it generates a magnetic field which produces a force which acts on the armature in the direction of the pole piece.

The described fuel injector is based on the knowledge that the electrically insulating element reduces the eddy currents in the armature and therefore improves the efficiency of the fuel injector, and that fitting the permanent magnet intensifies the voltage which is induced by the armature movement, so that this induced voltage can be used for detecting opening and closing of the fuel injector in the case of reduced eddy currents too. The magnetic field which is generated by the permanent magnet further leads to more rapid opening of the fuel injector, on account of the magnetic force acting on the armature, when a voltage pulse is applied to the coil. Therefore, overall, the present invention provides a fuel injector exhibiting improved efficiency and improved dynamics and detection properties.

According to one exemplary embodiment of the invention, the at least one electrically insulating element has or consists of a slot which is filled with air and/or an electrically insulating material and/or a non-magnetic material. Therefore, in the present context, an "electrically insulating element" is also understood to mean an air gap. In particular, any electrically insulating region which is designed specifically for reducing eddy currents in the armature constitutes an "electrically insulating element", even if the region is not formed by a solid body.

In other words, at least one slot is formed in the armature such that it interrupts a potential eddy current path. The slot can be filled exclusively with air, it can be filled exclusively with an electrically insulating material, it can be filled exclusively with a non-magnetic material or it can be filled with any desired combination of two or three of the above-mentioned substances/materials, such as, for example, a combination of air and electrically insulating material, a combination of air and non-magnetic material, a combination of electrically insulating material and non-magnetic material or a combination of air, electrically insulating material and non-magnetic material. In particular, the non-magnetic material is also electrically insulating.

The mechanical stability and the hydraulic properties of the armature can be improved by partially or completely filling the at least one slot with an electrically insulating material and/or a non-magnetic material.

The armature can be of integral or modular construction. In the case of integral construction, the at least one slot can be formed by cutting or milling during a casting process when forming the armature or thereafter. In the case of modular construction, the at least one slot can be formed between individual modules.

According to a further exemplary embodiment of the invention, the armature is formed from two or more sheet metal parts which are substantially insulated from one another by the at least one electrically insulating element.

In this exemplary embodiment, the armature is composed of a plurality of sheet metal parts, for example iron layers, which are entirely or partially isolated from one another by the at least one electrically insulating element, so that as many potential eddy current paths as possible are interrupted. The at least one electrically insulating element can, in particular, consist of a thin layer or film of insulating material.

According to a further exemplary embodiment of the invention, the at least one electrically insulating element extends radially relative to the movement axis of the armature.

In other words, the at least one electrically insulating element forms a surface which extends radially outward from the movement axis or from a region in the vicinity of the movement axis. By way of example, the slots which are filled with air or an electrically insulating solid material extend radially in the direction of the movement axis from the outside into the armature. The slots preferably extend over the entire length of the armature in the axial direction.

Preferred embodiments have one, two, three, four, five, six, seven, eight or even more insulating surfaces of said kind.

According to a further exemplary embodiment of the invention, the permanent magnet is fitted next to the coil in the direction of the movement axis of the armature. In other words, the permanent magnet is arranged subsequently to the coil in the direction of the movement axis.

In other words, in this exemplary embodiment, the permanent magnet is fitted either above or below the coil when said coil is viewed in the direction of the movement axis of the armature. In this configuration, the permanent magnet preferably has a radial magnetization, in order to form a magnetic field which surrounds the coil windings and produces a force which acts on the armature in the direction of the pole piece, that is to say parallel to the movement axis of the armature.

According to a further exemplary embodiment of the invention, the permanent magnet is fitted next to the coil and radially toward the outside relative to the movement axis of the armature. In other words, the permanent magnet is arranged subsequently to the coil radially to the outside. In particular, said permanent magnet surrounds the coil laterally in plan view along the movement axis.

In other words, in this exemplary embodiment, the permanent magnet is fitted on the outside of the coil when said coil is viewed in the direction of the movement axis of the armature. In this configuration, the permanent magnet preferably has an axial magnetization, in order to form a magnetic field which surrounds the coil windings and produces a force which acts on the armature in the direction of the pole piece, that is to say parallel to the movement axis of the armature.

According to a further exemplary embodiment of the invention, the fuel injector further has a coil housing which contains the permanent magnet.

The coil housing containing the permanent magnet surrounds at least that part of the coil which does not point in the direction of the movement axis or is situated toward the inside.

According to a further exemplary embodiment of the invention, the pole piece and/or the coil housing have/has at least one electrically insulating element which is designed to reduce eddy currents in the pole piece or coil housing.

In general, the at least one electrically insulating element in the pole piece and/or coil housing can be formed in a similar manner to the above-described electrically insulating element in the armature. In other words, the pole piece and/or the coil housing can be of modular, integral or laminated construction and the at least one electrically insulating element can be formed as a slot or a layer of insulating material.

According to a further exemplary embodiment of the invention, the armature and/or the pole piece and/or the coil housing comprise/comprises a material which generates few eddy currents. The material may be a soft-magnetic composite material which is formed, for example, from iron particles which are sheathed with an inorganic insulation. Materials of this kind are known to a person skilled in the art, for example under the trade name "Somaloy".

A second aspect of the invention describes a method for ascertaining a position of a movable armature in a fuel injector for an internal combustion engine of a motor vehicle. The fuel injector has a coil. The armature has at least one electrically insulating element which is designed to reduce eddy currents. The fuel injector has a permanent magnet which is fitted such that it generates a magnetic field which produces a force which acts on the armature in the direction of a pole piece.

The method comprises—possibly in addition to further optional steps—the following steps:

- detecting the time profile of the electrical voltage across and/or the electric current intensity through the coil,
- analyzing the detected time profile of the electrical voltage and/or of the detected time profile of the current intensity in order to identify an induced voltage and/or an induced current which are induced on account of the armature movement and the magnetic field, which is generated by the permanent magnet, in the coil, and determining the armature position based on the induced voltage and/or the induced current.

In an expedient refinement, the method additionally comprises the following steps:

supplying an operating current to the coil in order to move the armature from a closed position, in the direction of the pole piece, to an open position and, in particular, to hold said armature in the open position for the purpose of injecting fuel, disconnecting the operating current in order to initiate a closing process during which the armature returns from the open position to the closed position.

The time profile of the electrical voltage across and/or the electric current intensity through the coil can be detected during actuation of the fuel injector. In this case, actuation of the fuel injector is, in particular, supplying the operating current to the coil in order to move the armature from a closed position, in the direction of the pole piece, to an open position and to hold the armature optionally in the open position for the purpose of injecting fuel.

As an alternative or in addition, the time profile of the electrical voltage across and/or the electric current intensity through the coil can be detected during the closing process—that is to say after the operating current through the coil is disconnected.

In particular, the start and the end of opening and closing processes of the fuel injector are determined in the method. Particularly for detecting the induction voltage or the induced current of the coil during the closing process, the combination of the armature—which is provided with the electrically insulating element—with the permanent magnet is advantageous in order to actually obtain an induction signal which is satisfactory for position determination, in spite of the suppressed eddy currents.

A third aspect of the invention describes an engine controller for a vehicle, which engine controller is designed to carry out the method according to the second aspect.

This engine controller allows efficient and flexible actuation of the fuel injector, wherein energy can be saved during actuation and the injection quantities can be set in a very precise manner at the same time.

The engine controller can be realized both by means of a computer program, that is to say software, and also by means of one or more specific electrical circuits, that is to say using hardware or using any desired hybrid form, that is to say by means of software components and hardware components.

It should be noted that embodiments of the invention have been described with reference to different subjects of the invention. In particular, some embodiments of the invention are described by way of method claims and other embodiments of the invention are described by way of apparatus claims. However, it becomes immediately clear to a person skilled in the art upon reading this application that, unless explicitly stated otherwise, in addition to a combination of features which are associated with one type of subject matter of the invention, any combination of features which are associated with different types of subjects of the invention is also possible.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further advantages and features of the present invention can be found in the exemplary description of a preferred embodiment which follows.

DETAILED DESCRIPTION OF THE PREFERRED EMBODIMENTS

Figure 1:
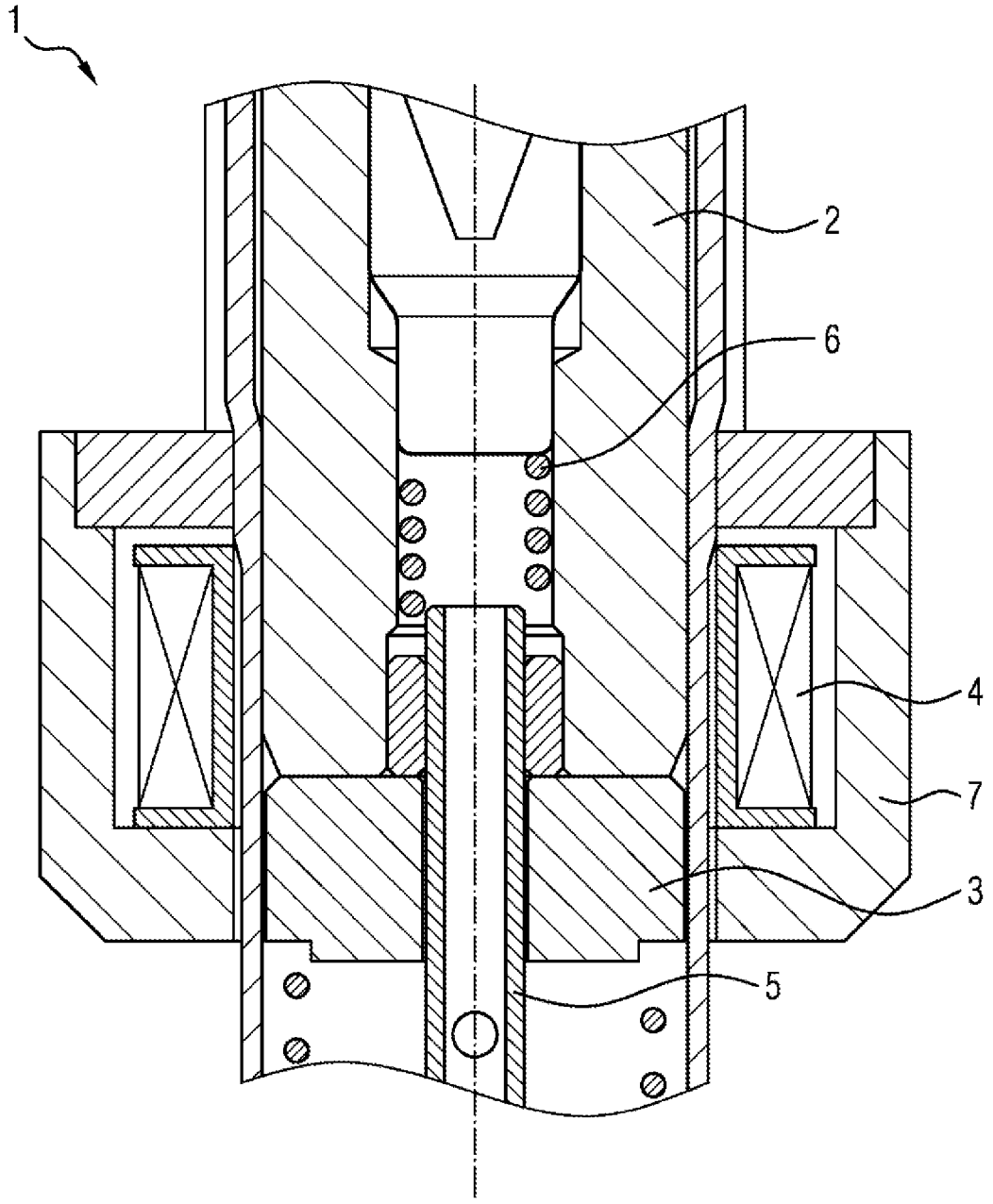
FIG 1 Prior art
FIG. 1 shows a fuel injector according to the prior art.

The following description of the preferred embodiment(s) is merely exemplary in nature and is in no way intended to limit the invention, its application, or uses.

It should be noted that the embodiments described below are merely a limited selection of possible variant embodiments of the invention. Identical or similar elements or elements which act in an identical manner are provided with the same reference numerals throughout the figures. In some figures, individual reference symbols can be omitted in order to improve clarity. The figures and the size ratios of the elements illustrated in the figures with respect to one another are not to be considered to be true to scale. Instead, individual elements can be illustrated with an exaggerated size for better illustration and/or for better understanding.

FIG. 1 shows a fuel injector 1 according to the prior art. The known fuel injector 1 with an idle stroke has, as described in the introductory part, a pole piece 2, a movable armature 3, a coil 4, a nozzle needle 5, a spring 6 and a coil housing 7. In order to avoid repetition, the known fuel injector 1 will not be described any further at this point.

Figure 2:
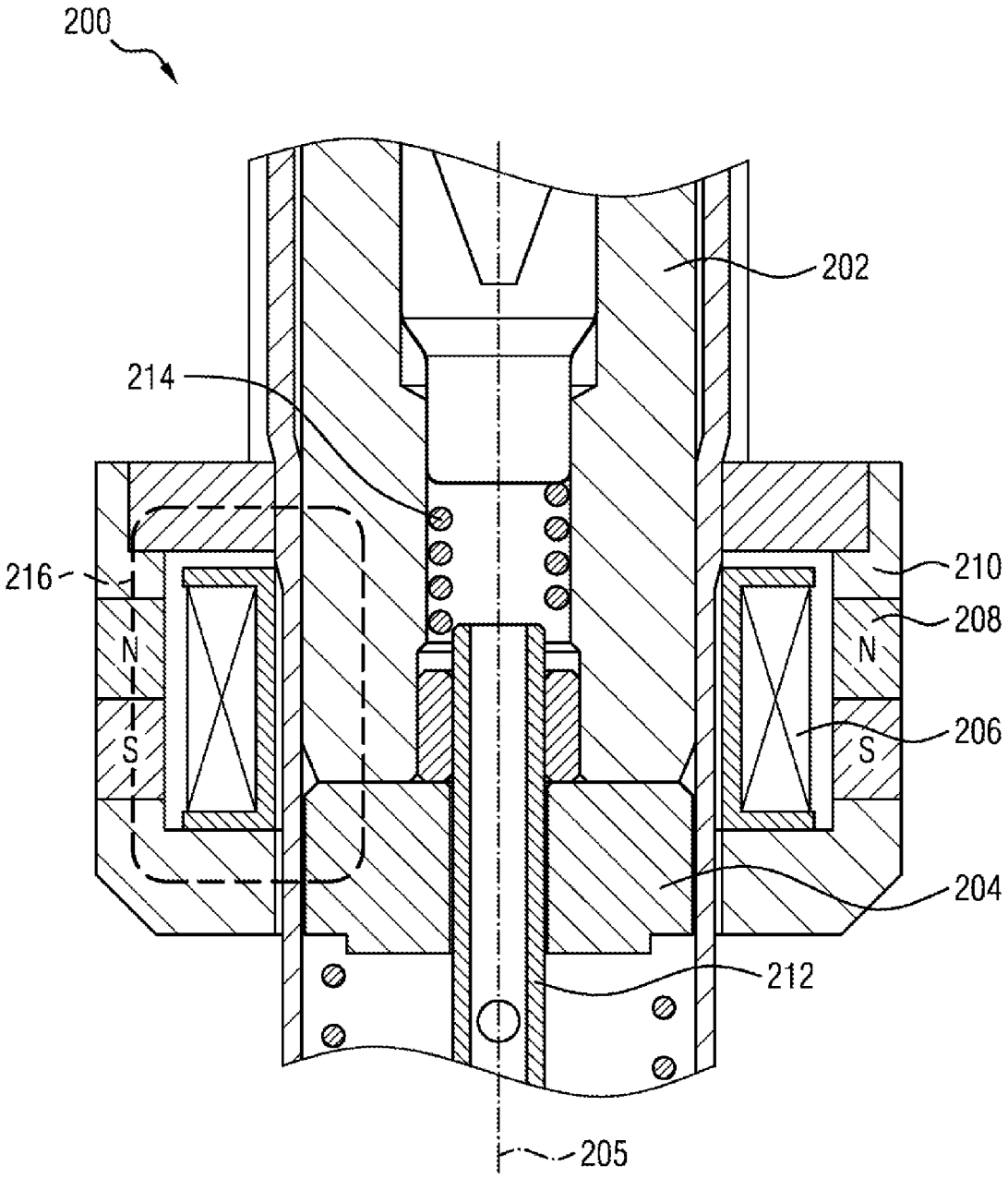
FIG. 2 shows a fuel injector according to one embodiment of the invention.

FIG. 2 shows a fuel injector 200 according to one embodiment of the invention. In principle, the fuel injector 200 is constructed in the same way as the known fuel injector 1 in FIG. 1 but, as will be explained further in the text which follows, differs from said known fuel injector in at least two aspects.

The fuel injector 200 with an idle stroke has, more specifically, a pole piece 202, an armature 204 which can be moved along a movement axis 205, a coil 206, a permanent magnet 208, a coil housing 210, a nozzle needle 212 and a spring 214. The permanent magnet 208 is fitted to the outside of the coil 206 in the coil housing 210 and is magnetized in a direction which is parallel to the movement axis 205 of the armature 204, with the result that a magnetic field, which is identified by the dashed line 216, is permanently present. The magnetic field 216 provides a force onto the armature 204, which force acts in the direction of the pole piece 202, that is to say parallel to the movement axis 205. This represents a first difference in comparison to the known fuel injector 1 in FIG. 1. A further difference is that the armature 204 has at least one electrically insulating element in order to reduce eddy currents in the armature 204. The at least one electrically insulating element is not shown in FIG. 2, but will be described below in conjunction with FIGS. 4A and 4B. Furthermore, the armature can be constructed from a special material, for example from a soft-magnetic composite material such as Somaloy®, which generates few eddy currents.

The reduction in eddy currents leads to an improved degree of energy efficiency on account of the correspondingly reduced losses, with the result that the requisite magnetic force can be reached with a lower current intensity in the coil 206. Consequently, the opening process can also be completed correspondingly more quickly. Said opening process is additionally assisted by the magnetic field 216 which is permanently present, since said magnetic field provides a force offset. If an increase in the closing speed is desired, the spring force of the spring 214 can be increased in comparison to the spring 6 in the known fuel injector 1. Furthermore, the magnetic field 216 which is permanently present leads to a voltage being induced in the coil 206 when the armature 204 and/or the needle 212 move. The state of the fuel injector 200 in relation to the opening and closing process can be detected, that is to say the position of the armature 204 can be ascertained, by evaluating this induced voltage or the corresponding current. In particular, the opening process can be best detected by evaluating the induced current.

Figure 3:
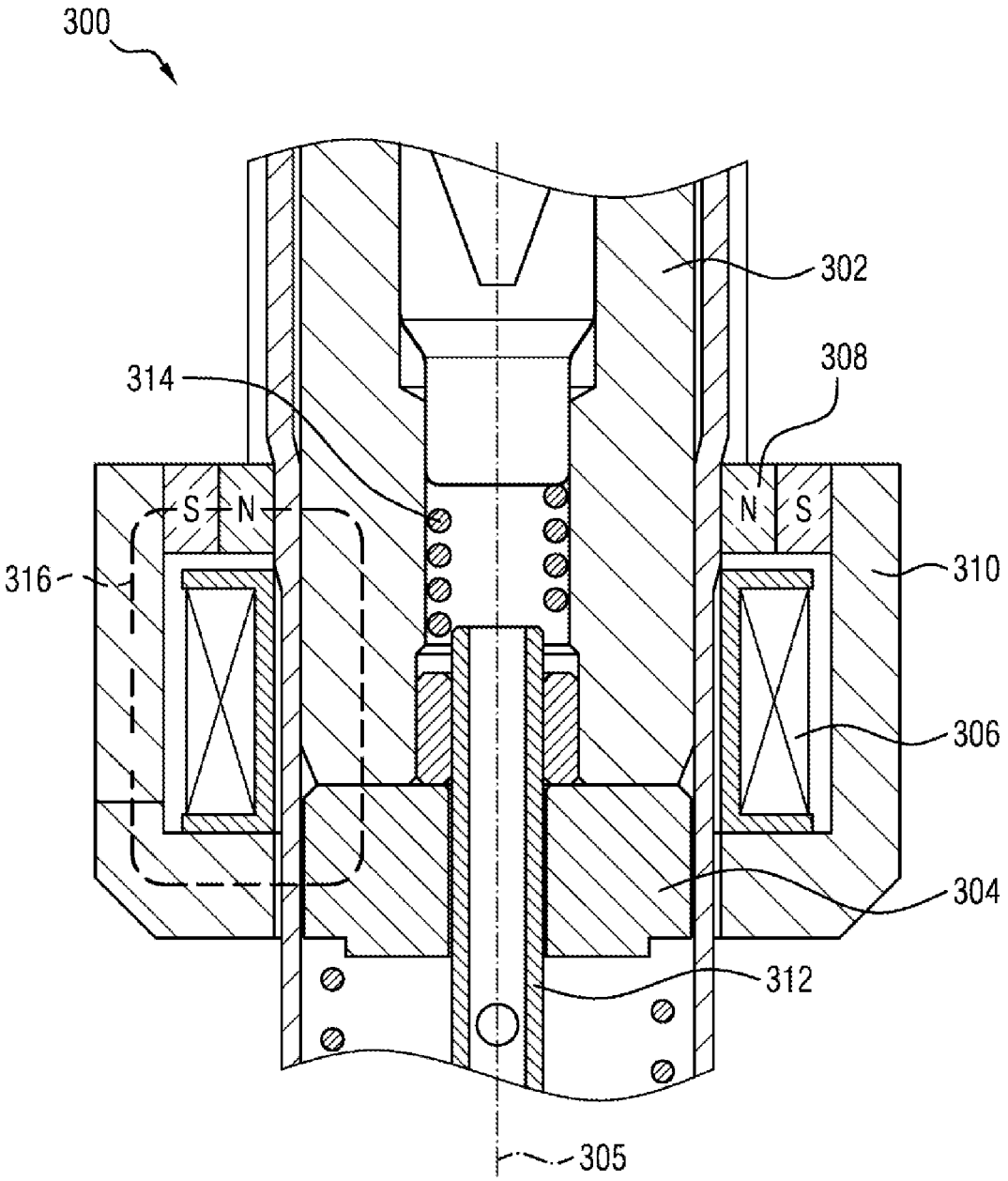
FIG. 3 shows a fuel injector according to a further embodiment of the invention.

FIG. 3 shows a fuel injector 300 according to a further embodiment of the invention. The fuel injector 300 differs from the fuel injector 200 shown in FIG. 2 and described above only in that the permanent magnet 308 is not fitted to the outside, but rather to the top side, of the coil 306. The permanent magnet 308 is magnetized in a direction which is perpendicular to the movement axis 305 of the armature 304, with the result that a magnetic field, which is identified by the dashed line 316, is permanently present in this embodiment too. In a further embodiment, not shown, the permanent magnet 308 is fitted on the bottom side of the coil 306.

Figure 4A:
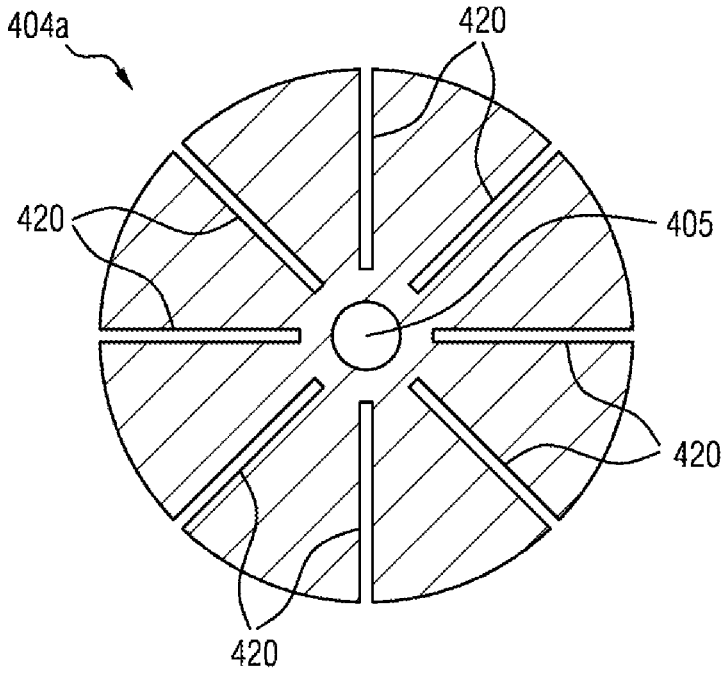
FIGS. 4A and 4B show designs of an armature for a fuel injector according to embodiments of the invention.
Figure 4B:
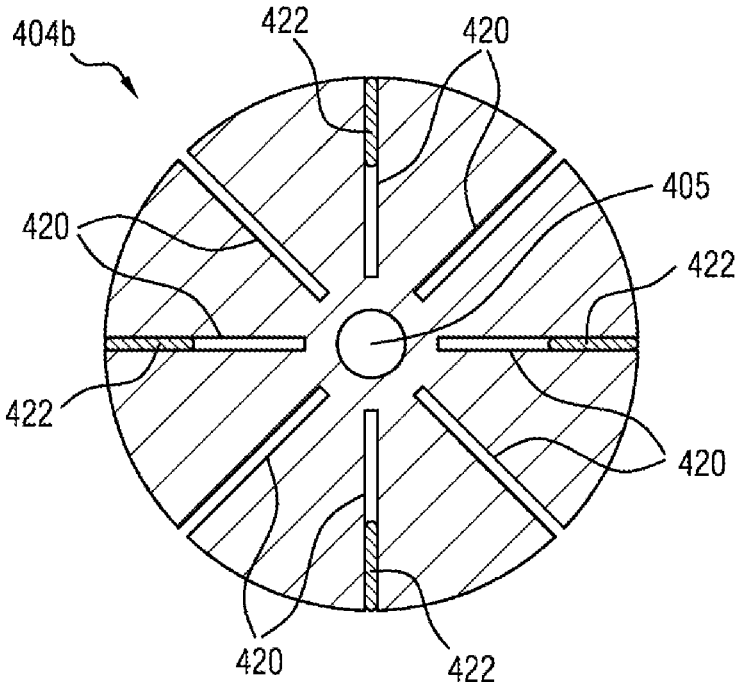

FIGS. 4A and 4B show designs of an armature 404*a*, 404*b* for a fuel injector according to embodiments of the invention. More specifically, the armature 404*a* in FIG. 4A has a total of eight electrically insulating elements 420 which extend radially outward relative to the movement axis 405 and therefore effectively interrupt possible eddy current paths in the armature 405. The electrically insulating elements 420 are shown as slots in the armature 404*a* in FIG. 4A, but can equally be in the form of insulating layers. In this case, the armature can be of modular or laminated construction. Less than or more than eight elements 420 can be provided. The slots 420 can be empty, that is to say filled with air, or, as is shown in FIG. 4B, they can be entirely or partially filled with an insulating and/or non-magnetic material 422, for example plastic, for example in order to influence the hydraulic properties of the armature 404*b*. The armature 404*a*, as 404*b*, can be produced from a material (for example a soft-magnetic composite material such as Somaloy®) which has the property of generating few eddy currents.

In the fuel injectors 200 and 300 described above with reference to FIGS. 2 and 3, electrically insulating elements can furthermore be provided in the pole piece 202, 302 in order to reduce eddy currents in the pole piece 202, 302 too and therefore to further improve efficiency and dynamics. Furthermore, electrically insulating elements can also be provided in the coil housing 210, 310 in order to reduce eddy currents in the coil housing 210, 310 and therefore to improve efficiency and dynamics even further. Insulating elements of this kind can be constructed, for example, in the same way as the elements 420 just described with reference to FIGS. 4A and 4B. Furthermore, the pole piece 202, 302 and the coil housing 210, 310 can also comprise an eddy current-reducing material, such as Somaloy® for example.

Figure 5:
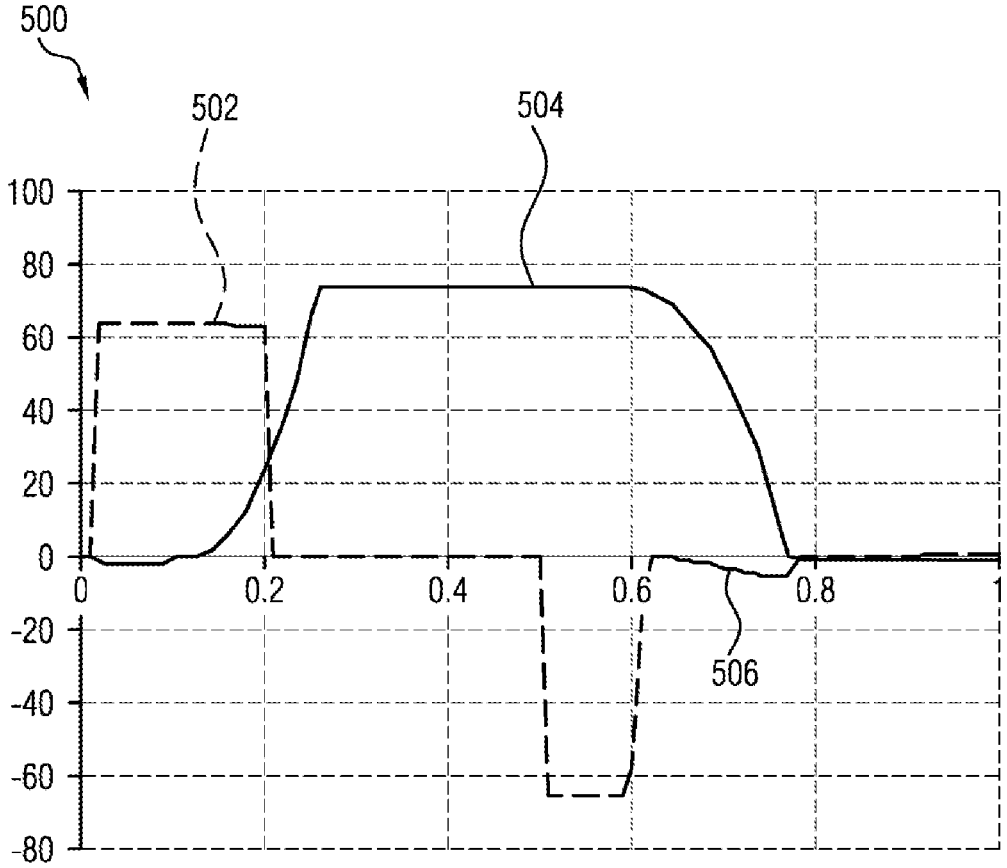
FIG. 5 shows a graphical illustration of the time profiles of coil voltage and armature position during actuation of a fuel injector according to the invention.

FIG. 5 shows a graphical illustration 500 of the time profiles of the voltage 502 induced in the coil 206, 306 and of the armature position 504 during an injection process of a fuel injector according to the invention, for example the fuel injector 200 or 300. Actuation is initiated with a voltage pulse (boost voltage) which quickly builds up an operating current through the coil 206, 306, said operating current magnetizing the coil 206, 306, with the result that the armature 204, 304 is moved from a closed position, in the direction of the pole piece 202, 302, to an open position. After the idle stroke has been overcome, the nozzle needle 212, 312 is carried along by the armature 204, 304 and is likewise moved in the direction of the pole piece 202, 302. Once the open position is reached—in the present exemplary embodiment at approximately t=0.25 ms—the armature 204, 304 is held at a stop against the pole piece 202, 302 by a holding voltage which is reduced in relation to the boost voltage. In this state, the voltage induced in the coil 206, 306 drops and disappears if the operating voltage does not change and the armature 204, 304 does not move.

The closing process is initiated, for example, by disconnecting the holding voltage—in the present exemplary embodiment at time t=0.5 ms. The resulting reduction in the electromagnetic field generates, for example, the rectangular profile of the induction voltage, shown between t=0.5 ms and t=0.6 ms in FIG. 5, in the coil 206, 306. After at least partial reduction of the electromagnetic field, the armature and the nozzle needle move—in the present case starting from t=0.6 ms—move away from the pole piece 202, 302 again in a manner driven by the spring force of the spring 214, 314. Owing to this movement and the permanent magnet, a voltage, which can be clearly seen in curve section 506, is induced in spite of the eddy current which is greatly reduced by means of the slots 420 in the armature 204, 304, it being possible to use said voltage to detect the start and the end of the closing movement in a manner which is known per se. Although this is not clearly shown in FIG. 5, a detectable voltage and corresponding current are also induced during the opening movement, with the result that the start and the end of this movement can also be detected, in the best way by evaluating the current.

Overall, the present invention provides an improved fuel injector which has an improved degree of energy efficiency in comparison to known fuel injectors and also has improved properties in respect of movement detection.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel injection apparatus for an internal combustion engine of a motor vehicle, the fuel injection apparatus comprising:

a fuel injector, comprising a pole piece;

an armature which may be moved along a movement axis;

a coil;

a permanent magnet; and at least one electrically insulating element, the movable armature having the at least one electrically insulating element, which is designed to reduce eddy currents in the armature;

wherein the permanent magnet is fitted such that the permanent magnet generates a magnetic field which produces a force which acts on the armature in the direction of the pole piece.

2. The fuel injection apparatus of claim 1, the at least one electrically insulating element further comprising a slot which is filled with at least one of air, an electrically insulating material, or a non-magnetic material.

3. The fuel injection apparatus of claim 1, wherein the armature is formed from two or more sheet metal parts which are substantially insulated from one another by the at least one electrically insulating element.

4. The fuel injection apparatus of claim 1, wherein the at least one electrically insulating element extends radially relative to the movement axis of the armature.

5. The fuel injection apparatus of claim 1, wherein the permanent magnet is fitted onto the coil subsequently in the direction of the movement axis of the armature.

6. The fuel injection apparatus of claim 1, wherein the permanent magnet is subsequently fitted radially toward the outside of the coil relative to the movement axis of the armature.

7. The fuel injection apparatus of claim 1, further comprising a coil housing which contains the permanent magnet.

8. The fuel injection apparatus of claim 7, wherein the coil housing has at least one electrically insulating element which is designed to reduce eddy currents in the coil housing.

9. The fuel injection apparatus of claim 7, the coil housing further comprising a material which generates few eddy currents.

10. The fuel injection apparatus of claim 1, the armature further comprising a material which generates few eddy currents.

11. The fuel injection apparatus of claim 1, the pole piece further comprising a material which generates few eddy currents.

12. The fuel injection apparatus of claim 1, wherein the pole piece has at least one electrically insulating element which is designed to reduce eddy currents in the pole piece.

13. A method for ascertaining a position of a movable armature in a fuel injector for an internal combustion engine of a motor vehicle, wherein the fuel injector has a coil, the armature has at least one electrically insulating element which is designed to reduce eddy currents, and the fuel injector has a permanent magnet which is fitted such that it generates a magnetic field which produces a force which acts on the armature in the direction of a pole piece the method comprising the steps of:

detecting the time profile of the electrical voltage across the coil;

analyzing the detected time profile of the electrical voltage in order to identify an induced voltage which is induced on account of the armature movement and the magnetic field, which is generated by the permanent magnet, in the coil, and determining the armature position based on the induced voltage.

14. The method as claimed in claim 13, comprising the further steps of:

supplying an operating current to the coil in order to move the armature from a closed position, in the direction of the pole piece, to an open position for the purpose of injecting fuel;

disconnecting the operating current in order to initiate a closing process during which the armature returns from the open position to the closed position, wherein the time profile of the electrical voltage across the coil is detected during the closing process.

15. The method of claim 13, further comprising the steps of:

providing an engine controller for a vehicle, wherein the engine controller performs the steps of detecting the time profile, analyzing the detected time profile, and determining the armature position.

16. A method for ascertaining a position of a movable armature in a fuel injector for an internal combustion engine of a motor vehicle, wherein the fuel injector has a coil, the armature has at least one electrically insulating element which is designed to reduce eddy currents, and the fuel injector has a permanent magnet which is fitted such that it generates a magnetic field which produces a force which acts on the armature in the direction of a pole piece, the method comprising the steps of:

detecting the time profile of the electric current intensity through the coil;

analyzing the detected time profile of the current intensity in order to identify an induced current which is induced on account of the armature movement and the magnetic field, which is generated by the permanent magnet, in the coil; and determining the armature position based on the induced current.

17. The method as claimed in claim 16, comprising the further steps of:

supplying an operating current to the coil in order to move the armature from a closed position, in the direction of the pole piece, to an open position for the purpose of injecting fuel;

disconnecting the operating current in order to initiate a closing process during which the armature returns from the open position to the closed position, wherein the time profile of the electric current intensity through the coil is detected during the closing process.

18. The method of claim 16, further comprising the steps of: providing an engine controller for a vehicle, wherein the engine controller performs the steps of detecting the time profile, analyzing the detected time profile, and determining the armature position.

19. The fuel injection apparatus of claim 1, further comprising an engine controller which provides an operating current to the coil in order to move the armature, the engine controller configured to perform a method comprising detecting a time profile of at least one of an electrical voltage across and an electric current intensity through the coil;

analyzing the detected time profile in order to identify at least one of an induced voltage and an induced current which is induced on account of the armature movement and the magnetic field, which is generated by the permanent magnet, in the coil;

determining the armature position based on the at least one of the induced voltage and the induced current; and supplying an operating current to the coil in order to move the armature from a closed position, in the direction of the pole piece, to an open position for the purpose of injecting fuel; and disconnecting the operating current in order to initiate a closing process during which the armature returns from the open position to the closed position, wherein the time profile is detected during the closing process.

* * * * *